US011215150B1

(12) United States Patent
Kim et al.

(10) Patent No.: US 11,215,150 B1
(45) Date of Patent: Jan. 4, 2022

(54) FUEL FILLING SYSTEM OF FUEL PUMP RESERVOIR

(71) Applicants: HYUNDAI MOTOR COMPANY, Seoul (KR); KIA MOTORS CORPORATION, Seoul (KR)

(72) Inventors: Keun Soo Kim, Yongin-si (KR); Jung Hoon Park, Suwon-si (KR); Dong Hyun Kim, Hwaseong-si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 0 days.

(21) Appl. No.: 17/219,060

(22) Filed: Mar. 31, 2021

(30) Foreign Application Priority Data

Sep. 23, 2020 (KR) ..... 10-2020-0122812

(51) Int. Cl.

| | |
|---|---|
| ***F02M 1/00*** | (2006.01) |
| ***F02M 37/02*** | (2006.01) |
| ***F02D 41/30*** | (2006.01) |
| ***F02M 63/00*** | (2006.01) |

(52) U.S. Cl.
CPC ..... *F02M 37/025* (2013.01); *F02D 41/3082* (2013.01); *F02M 63/005* (2013.01); *F02D 2200/0602* (2013.01); *F02D 2200/0625* (2013.01); *F02D 2250/31* (2013.01)

(58) Field of Classification Search
CPC ..... F02D 41/3082; F02M 25/0836; F02M 25/089
USPC ..... 123/516–520, 497
See application file for complete search history.

(56) References Cited

U.S. PATENT DOCUMENTS

| | | | | |
|---|---|---|---|---|
| 7,469,683 | B2 * | 12/2008 | Mason | F02M 37/0023 123/509 |
| 2004/0139946 | A1 * | 7/2004 | Hamada | F02M 37/20 123/458 |
| 2008/0127944 | A1 * | 6/2008 | Ramamurthy | F02M 37/106 123/457 |
| 2013/0248027 | A1 * | 9/2013 | Gutscher | F02M 37/025 137/565.11 |
| 2017/0260943 | A1 * | 9/2017 | Hayashi | F02M 37/025 |
| 2017/0314522 | A1 * | 11/2017 | Takahashi | F02M 55/04 |
| 2018/0017009 | A1 * | 1/2018 | Kim | F02D 41/3082 |

FOREIGN PATENT DOCUMENTS

| | | | |
|---|---|---|---|
| JP | 2010-216433 | A | 9/2010 |
| KR | 10-0660684 | B | 12/2006 |
| KR | 10-1181672 | B | 9/2012 |
| KR | 10-2020-0054510 | A | 5/2020 |

* cited by examiner

*Primary Examiner* — John Kwon
(74) *Attorney, Agent, or Firm* — Lempia Summerfield Katz LLC

(57) ABSTRACT

The fuel filling system of a fuel pump reservoir includes: a reservoir mounted in a fuel tank; a fuel pump mounted in the reservoir and configured to deliver the fuel in the reservoir to an engine and to discharge a portion of the fuel to a fuel branch line; a relief valve disposed on a fuel supply line and configured to release pressure applied to the fuel supply line; a first jet pump configured to fill the reservoir with the fuel using fuel jet flow from the fuel branch line; a second jet pump configured to fill the reservoir with the fuel using fuel jet flow from a fuel return line; and a fuel pump control module (FPCM) configured to control operation of the second jet pump based on a driving mode of a vehicle.

11 Claims, 5 Drawing Sheets

FUEL FILLING SYSTEM OF FUEL PUMP RESERVOIR

CROSS-REFERENCE TO RELATED APPLICATION

This application claims priority to and the benefit of Korean Patent Application No. 10-2020-0122812, filed on Sep. 23, 2020, the entire contents of which are incorporated herein by reference.

FIELD

The present disclosure relates to a fuel filling system of a fuel pump reservoir.

BACKGROUND

The statements in this section merely provide background information related to the present disclosure and may not constitute prior art.

In general, a fuel supply apparatus of a vehicle smoothly supplies fuel desired for an engine under all driving conditions, and is one of factors which greatly influence the output or performance of the engine. A fuel tank configured to store the fuel supplied to the engine is provided in the vehicle, and a reservoir is mounted in the fuel tank so as to smoothly supply the fuel to the engine without deficiency. The fuel in the reservoir is supplied to the engine through a fuel pump. In order to sufficiently keep the reservoir filled with the fuel despite supply of the fuel to the engine, a jet pump is disposed in the reservoir.

However, we have discovered that when the vehicle is traveling under the maximum fuel consumption conditions, such as when high-speed driving on a racing circuit (i.e., a track on which vehicles race), the amount of fuel in the reservoir is insufficient, and thus engine hesitation and stalling may occur. In order to improve the fuel filling performance of the reservoir, a method for increasing the flow rate of the fuel pump towards a motor may be applied. But in track driving under low fuel conditions, filling the reservoir with the fuel merely by increasing the flow rate towards the motor may be limited. Further, a method for disposing a plurality of jet pumps in a reservoir may be employed, but in this case, two or more jet pumps are always operated, and thus fuel efficiency of a vehicle is lowered.

The above information disclosed in this Background section is only for enhancement of understanding of the background of the disclosure and therefore it may contain information that does not form the prior art that is already known to a person of ordinary skill in the art.

SUMMARY

The present disclosure provides a fuel filling system of a fuel pump reservoir which may improve capability to fill the reservoir with fuel from a fuel tank when a vehicle drives on a track at a high speed.

The present disclosure provides a fuel filling system of a fuel pump reservoir which varies the number of jet pumps operated depending on the driving mode of a vehicle.

In one form, the present disclosure provides a fuel filling system of a fuel pump reservoir including: a reservoir mounted in a fuel tank configured to store fuel; a fuel pump mounted in the reservoir and configured to deliver the fuel in the reservoir to an engine and to discharge a portion of the fuel to a fuel branch line, simultaneously; a relief valve disposed on a fuel supply line, and configured to deliver the fuel from the fuel pump to the engine and to release pressure applied to the fuel supply line; a first jet pump configured to fill the reservoir with the fuel in the fuel tank using fuel jet flow from the fuel branch line; a second jet pump configured to fill the reservoir with the fuel in the fuel tank using fuel jet flow from a fuel return line that is configured to receive the fuel returning from the relief valve; and a fuel pump control module (FPCM) configured to control operation of the second jet pump based on a driving mode of a vehicle.

In one form, the driving mode of the vehicle may be one of a general mode or a track mode, and the driving mode of the vehicle may be determined by a cluster.

In another form, upon determining that the driving mode of the vehicle is the track mode, the FPCM may control the fuel pump to deliver the fuel at a predetermined pressure or higher.

In still another form, when a pressure of the fuel delivered from the fuel pump is equal to or greater than the predetermined pressure, the fuel may flow to the fuel return line by opening the relief valve, and an opening pressure of the relief valve may be lower than the predetermined pressure.

In yet another form, the second jet pump may be operated by the fuel flowing to the fuel return line.

In still yet another form, the fuel filling system may include a pressure sensor configured to measure a pressure of the fuel delivered to the engine and, when the pressure of the fuel measured by the pressure sensor deviates from a normal range, the FPCM may fix a duty of the fuel pump to 100%.

In a further form, when the pressure of the fuel measured by the pressure sensor is within the normal range, the FPCM may maintain the opening pressure of the relief valve.

In another further form, when the pressure of the fuel delivered from the fuel pump is lower than an opening pressure of the relief valve, the first jet pump alone may be operated, and when the pressure of the fuel delivered from the fuel pump is equal to or higher than the opening pressure of the relief valve, both the first jet pump and the second jet pump may be operated.

In still another further form, the first jet pump may include a first nozzle having a first injection hole through which the fuel passes, the second jet pump may include a second nozzle having a second injection hole through which the fuel passes, and a diameter of the second injection hole may be greater than a diameter of the first injection hole.

In yet another further form, the driving mode of the vehicle may be determined by a cluster, and the cluster may determine whether or not the driving mode of the vehicle is a general mode or a track mode based on whether or not an electronic stability control (ESC) device applied to the vehicle is turned off.

In still yet another further form, the driving mode of the vehicle is determined by a cluster, and the cluster may determine whether or not the driving mode of the vehicle is a general mode or a track mode by comparing a damping time, which is a set value configured to limit a falling time of a fuel level in a fuel gauge, with a response time, which is an actual falling time of the fuel level in the fuel gauge from a full level to an empty level due to fuel consumption of the engine.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
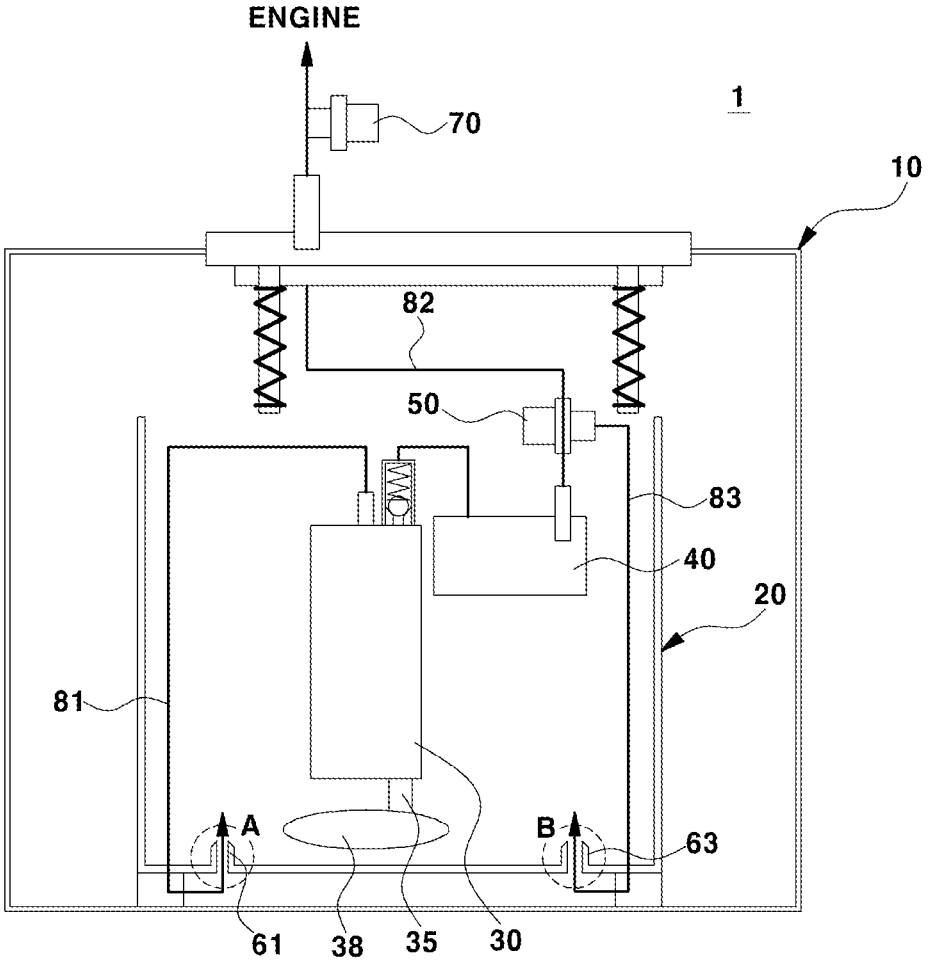
FIG. 1 is a view illustrating a fuel filling system of a fuel pump reservoir according to one form of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Advantages and features of the present disclosure and methods for achieving the same will become apparent from the descriptions of various forms herein below with reference to the accompanying drawings. It should be understood that the appended drawings are not necessarily to scale, presenting a somewhat simplified representation of various preferred features illustrative of the basic principles of the disclosure. The specific design features of the present disclosure as disclosed herein, including, for example, specific dimensions, orientations, locations, and shapes will be determined in part by the particular intended application and use environment. In the figures, reference numbers refer to the same or equivalent parts of the present disclosure throughout the several figures of the drawing.

The present disclosure is not limited to the forms disclosed herein and may be implemented in various different forms. Various forms are provided to make the description of the present disclosure thorough and to fully convey the scope of the present disclosure to those skilled in the art. It is to be noted that the scope of the present disclosure is defined only by the claims. In the following description of the present disclosure, the same or similar elements are denoted by the same reference numerals even though they are depicted in different drawings.

In the following description of the forms, it will be understood that the suffixes "part", "unit" and "module" indicate units for processing at least one function or operation, and may be implemented using hardware, software, or a combination of hardware and software.

Further, in the following description, terms, such as "first" and "second", are used only to describe various elements, and these elements should not be construed to be limited by these terms. These terms are used only to distinguish one element from other elements. For example, a first element described hereinafter may be termed a second element, and similarly, a second element described hereinafter may be termed a first element, without departing from the scope of the disclosure.

Hereinafter reference will be made in detail to various forms of the present disclosure, examples of which are illustrated in the accompanying drawings and described below. While the disclosure will be described in conjunction with exemplary forms, it will be understood that the present description is not intended to limit the disclosure to the exemplary forms. On the contrary, the disclosure is intended to cover not only the exemplary forms, but also various alternatives, modifications, equivalents and other forms, which may be included within the spirit and scope of the disclosure as defined by the appended claims. In addition, the claims disclosed herein are to be interpreted as encompassing other forms.

Figure 2A:
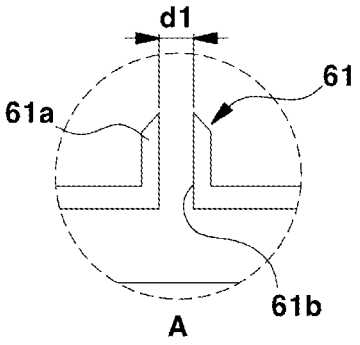
FIGS. 2A and 2B are views illustrating jet pumps according to one form of the present disclosure.
Figure 2B:
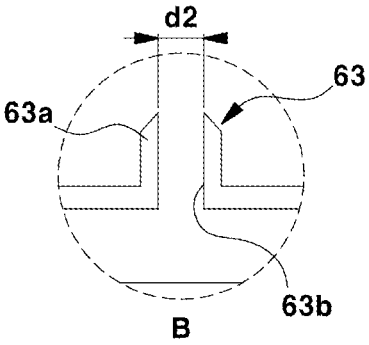

FIG. 1 is a view illustrating a fuel filling system of a fuel pump reservoir according to one form of the present disclosure, and FIGS. 2A and 2B are views illustrating jet pumps according to one form of the present disclosure.

Referring to FIGS. 1, 2A and 2B, a fuel filling system 1 of a fuel pump reservoir includes a fuel tank 10, a reservoir 20, a fuel pump 30, a filter 40, a relief pump 50 and jet pumps 61, 63. The reservoir 20, the fuel pump 30, the filter 40, the relief pump 50 and the jet pumps 61, 63 may be disposed in the fuel tank 10.

The reservoir 20 may be mounted in the fuel tank 10, which stores fuel. The reservoir 20 may a space which is filled with the fuel in advance so as to smoothly supply the fuel under severe driving conditions, such as in the state in which the amount of the fuel in the fuel tank 10 is insufficient or when the vehicle drives on a slope.

The fuel pump 30 may be mounted in the reservoir 20 and deliver the fuel in the reservoir 20 to an engine. The fuel pump 30 may discharge a portion of the fuel in the reservoir 20 to a fuel branch line 81. The fuel which the fuel pump 30 discharges to the engine may flow into the filter 40. A fuel inlet 35 may be provided in the lower portion of the fuel pump 30, and be connected to an inflow filter 38. The inflow filter 38 may filter the fuel when the fuel in the reservoir 20 flows into the fuel pump 30. The fuel filtered by the inflow filter 38 may flow into the fuel pump 30 through the fuel inlet 35.

The filter 40 may serve to filter the fuel pumped to the engine from the fuel pump 30. The fuel having passed through the filter 40 may flow into the relief valve 50.

The relief valve 50 may be disposed on a fuel supply line 82 along which the fuel is delivered from the fuel pump 30 to the engine. The relief valve 50 may release pressure applied to the fuel supply line 82. That is to say, if high-pressure fuel flows along the fuel supply line 82, the relief valve 50 may allow a portion of the fuel to flow to a fuel return line 83. The relief valve 50 may be opened when the pressure of the fuel reaches the opening pressure of the relief valve 50. For example, the opening pressure of the relief valve 50 may be 5.5 bar. Therefore, when the pressure of the fuel applied to the relief valve 50 is greater than the opening pressure of the relief valve 50, the fuel may flow to the fuel supply line 82 and the fuel return line 83.

The jet pumps 61, 63 may be disposed in the lower portion of the reservoir 20. The jet pumps 61, 63 may include a first jet pump 61 which fills the reservoir 20 with the fuel in the fuel tank 10 using fuel jet flow from the fuel branch line 81, and a second jet pump 63 which fills the reservoir 20 with the fuel in the fuel tank 10 using fuel jet flow from the fuel return line 83 to which the fuel from the relief valve 50 returns. The first jet pump 61 may be connected to the fuel branch line 81, and the second jet pump 63 may be connected to the fuel return line 83. The first jet pump 61 may be always operated because the fuel is always supplied thereto through the fuel branch line 81. The second jet pump 63 may be operated only when the relief valve 50 is opened because the fuel from the fuel return line 83 is supplied thereto only when the relief valve 50 is opened. That is, the second jet pump 63 may be operated only when the pressure of the fuel flowing into the relief valve 50 is greater than the opening pressure of the relief valve 50.

The first jet pump 61 may include a first nozzle 61*a* having a first injection hole 61*b* through which the fuel passes. The second jet pump 63 may include a second nozzle 63*a* having a second injection hole 63*b* through which the fuel passes. The first injection hole 61*b* and the second injection hole 63*b* may indicate open spaces configured such that the fuel passes therethrough. Here, the diameter d2 of the second injection hole 63*b* may be greater than the diameter d1 of the first injection hole 61*b*. As the pressure of the fuel delivered from the fuel pump 30 is increased, the pressure of the fuel flowing into the second jet pump 63 may be increased. When the vehicle drives on a track, the pressure of the fuel delivered from the fuel pump 30 may often be considerably greater than the opening pressure of the relief valve 50. In this case, in order to inhibit an increase in the total pressure of the system including the fuel return line 83, the diameter d2 of the second injection hole 63*b* may be greater than the diameter d1 of the first injection hole 61*b*.

A pressure sensor 70 may be disposed on the fuel supply line 82. The pressure sensor 70 may measure the pressure of the fuel supplied to the engine. The pressure of the fuel measured by the pressure sensor 70 may be transmitted to a fuel pump control module (FPCM) which will be described later.

When the amount of the fuel in the fuel tank 10 is insufficient under the maximum fuel consumption conditions of the engine for high-performance vehicles, such as when high-speed track driving on a track, the amount of the fuel in the reservoir 20 in the fuel tank 10 is insufficient, and thus engine hesitation and stalling may occur. According to one form of the present disclosure, when the vehicle drives on a general road, a situation in which the pressure of the fuel becomes greater than the opening pressure of the relief valve 50 may almost never occur, but when the vehicle drives on a track, the vehicle frequently performs sudden acceleration, sudden deceleration and sudden turning, and the pressure of the fuel delivered from the fuel pump 30 may be greater than the opening pressure of the relief valve 50. Therefore, the fuel filling system 1 may include the second jet pump 63 so as to supplement capability to fill the reservoir 20 with fuel when the driving mode of the vehicle is a track mode. Because the second jet pump 63 is applied to the fuel filling system 1, the total pressure of the fuel filling system 1 may be lowered, and capability to fill the reservoir 20 with fuel may be improved in the severe driving conditions of the vehicle (i.e., in the track mode).

Figure 3:
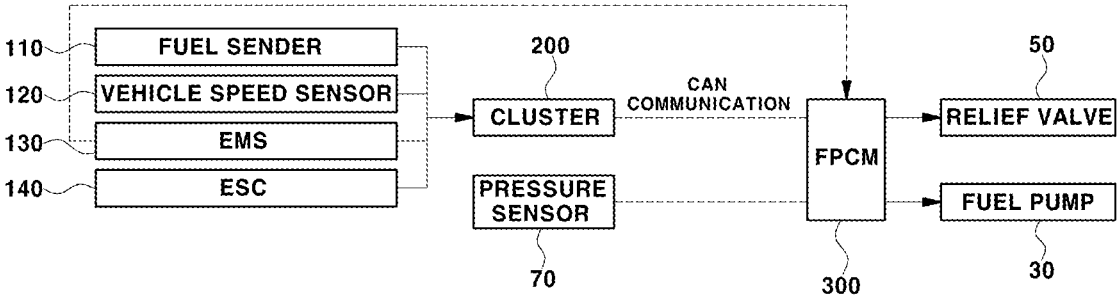
FIG. 3 is a block diagram illustrating the fuel filling system according to the present disclosure.

FIG. 3 is a block diagram illustrating the fuel filling system according to the present disclosure.

Referring to FIGS. 1 and 3, a fuel pump control module (hereinafter referred to as 'FPCM') 300 may control the fuel pump 30 and the relief valve 50 applied to the fuel filling system 1. The FPCM 300 may include a separate controller. The FPCM 300 may receive information regarding the driving mode of the vehicle from a cluster 200, and receive information regarding the pressure of the fuel supplied to the engine from the pressure sensor 70.

The cluster 200 may determine the driving mode of the vehicle. Information regarding the driving mode of the vehicle determined by the cluster 200 may be transmitted to the FPCM 300 through CAN communication. As one example, the cluster 200 may determine whether the driving mode of the vehicle is a general mode or the track mode by comparing a damping time, which is a set value to limit the falling time of a fuel level in a fuel gauge, with a response time, which is an actual falling time of the fuel level in the fuel gauge from a full level to an empty level due to fuel consumption of the engine. The cluster 200 may receive information regarding a fuel amount difference between the full level and the empty level in the fuel gauge from a fuel sender 110. Here, the information regarding the fuel amount difference between the full level and the empty level in the fuel gauge may be a value which is input to the cluster 200 in advance. Further, the cluster 200 may receive information regarding the speed of the vehicle from a vehicle speed sensor 120. The speed of the vehicle may be used to determine the driving mode of the vehicle by applying the damping time which is set to be different depending on the speed. In addition, the cluster 200 may receive fuel consumption (FCO) from an engine management system (EMS) 130. The EMS 130 may calculate the fuel consumption (FCO) of the engine based on an air-fuel ratio.

As another example, the cluster 200 may determine whether the driving mode of the vehicle is the general mode or the track mode based on whether or not an electronic stability control (ESC) device 140 applied to the vehicle is turned off. The ESC device 140 may control a brake and engine torque in the state in which the posture of the vehicle is in danger so as to secure stability of the vehicle. As one example, when a pedal of the vehicle is strongly pressed, the ESC device 140 may control the output of the engine so as to inhibit spinning of wheels. As another example, when oversteering occurs during turning of the vehicle, the ESC device 140 may control the posture of the vehicle through distribution of boosting force of the brake to the respective wheels. In general, the vehicle driving on a track drives in the state in which vehicle stability control by the ESC device 140 is turned off. Therefore, upon confirming that vehicle stability control by the ESC device 140 is turned off, the cluster 200 may determine that the driving mode of the vehicle is the track mode.

The FPCM 300 may control the intensity of operation of the fuel pump 30 so as to adjust the pressure of the fuel flowing into the engine. The EMS 130 may set the target pressure of the fuel supplied to the engine. The target pressure may be set based on the RPM of the engine, the torque of the engine, etc. The target pressure value set by the EMS 130 may be transmitted to the FPCM 300, and the FPCM 300 may control the intensity of operation of the fuel pump 30 based on the target pressure value. The FPCM 300 may calculate a feedback duty based on a difference between the pressure of the fuel detected by the pressure sensor 70 and the target pressure value, and calculate a basic duty based on the fuel consumption.

The FPCM 300 may control the intensity of operation of the fuel pump 30 based on the driving mode of the vehicle transmitted by the cluster 200. When the driving mode of the vehicle is the general mode (meaning an ordinary driving mode), the pressure of the fuel delivered by the fuel pump 30 may be controlled to be 3.5 bar to 5 bar. That is, when the driving mode of the vehicle is the general mode, the relief valve 50 may not be opened or the second jet pump 63 may not be operated. When the driving mode of the vehicle is the track mode, the FPCM 300 may control the pressure of the fuel delivered by the fuel pump 30 to be 6 bar or higher. When the driving mode of the vehicle is the track mode, the relief valve 50 may be opened and the second pump 63 may be operated.

When the driving mode of the vehicle is the track mode, the FPCM 300 may control the duty of the fuel pump 30 and the opening pressure of the relief valve 50 based on whether or not the output value of the pressure sensor 70 is within a normal range. When the pressure sensor 70 fails, the output value of the pressure sensor 70 may deviate from the normal range. For example, when the output value of the pressure sensor 70 is 3.7 V or higher, the FPCM 300 may determine that the pressure sensor 70 has failed. The FPCM 300 may fix the duty of the fuel pump 30 to 100% when the output value of the pressure sensor 70 deviates from a normal range. When the driving mode of the vehicle is the track mode, the amount of fuel supplied to the engine may be considerably large, and a portion of the total pressure of the system may be released through the relief valve 50. Therefore, the FPCM 300 may control the duty of the fuel pump 30 to 100% when the output value of the pressure sensor 70 deviates from the normal range, based on the fuel consumption depending on the driving mode of the vehicle. The FPCM 300 may maintain the duty of the fuel pump 30 and the opening pressure of the relief valve 50 in the current state when the output value of the pressure sensor 70 is within the normal range.

That is to say, when the pressure of the fuel discharged from the fuel pump 30 is lower than the opening pressure of the relief valve 50, the first jet pump 61 alone may be operated, and when the pressure of the fuel discharged from the fuel pump 30 is equal to or higher than the opening pressure of the relief valve 50, both the first jet pump 61 and the second jet pump 63 may be operated.

According to one form of the present disclosure, whether or not the second jet pump 63 is operated may be determined depending on the driving mode of the vehicle, and thus, the fuel may be smoothly supplied to the engine in the track mode of the vehicle.

In addition, according to one form of the present disclosure, when the pressure sensor 70 fails, the duty of the fuel pump 30 is fixed to 100%, thereby facilitating smooth fuel supply to the engine in the track mode of the vehicle.

Figure 4:
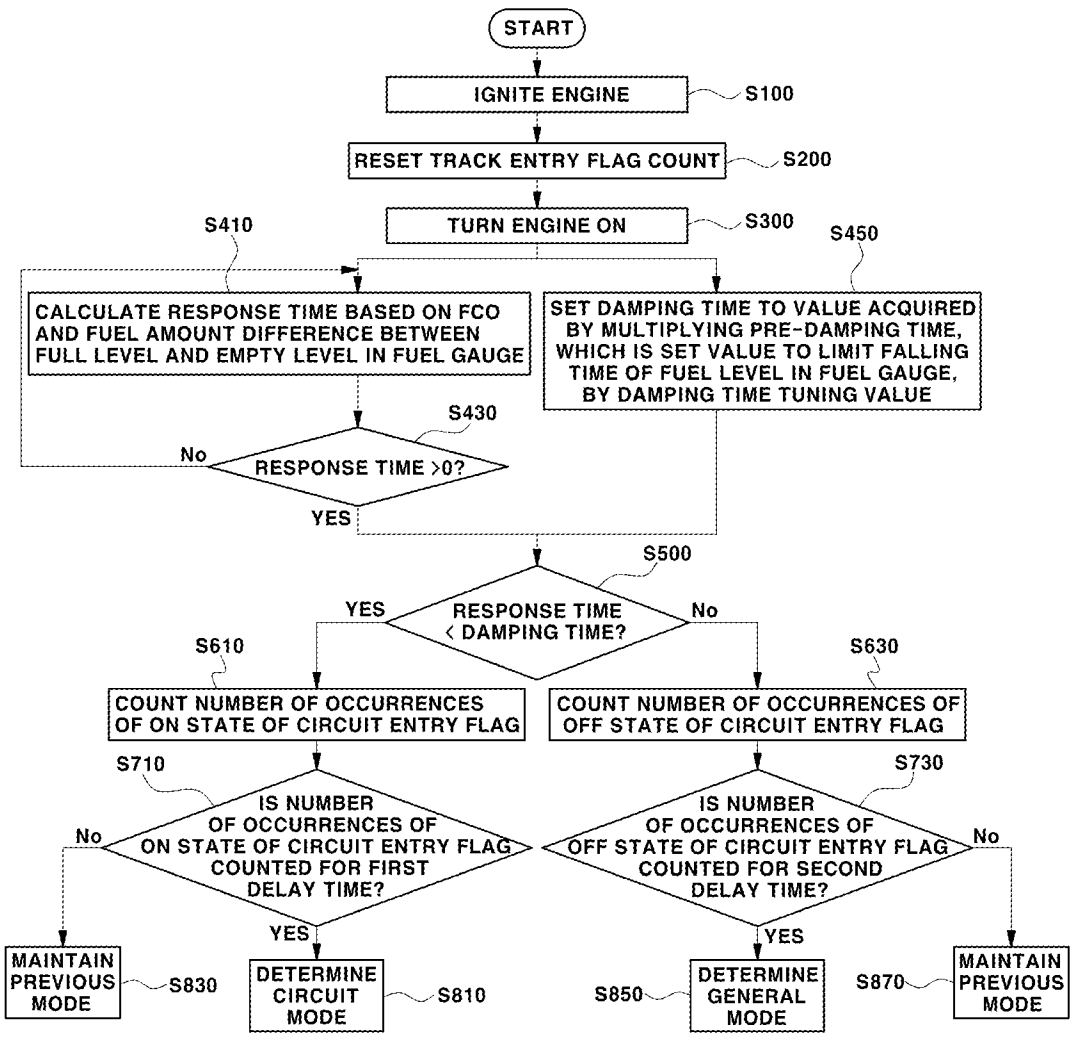
FIG. 4 is a flowchart illustrating a method for determining the driving mode of a vehicle according to one form of the present disclosure.

FIG. 4 is a flowchart illustrating a method for determining the driving mode of the vehicle according to one form of the present disclosure.

Referring to FIGS. 3 and 4, after ignition of the engine occurs (IG ON) (S100), the cluster 200 may reset a track entry flag count (S200).

When the engine is turned on (S300), the cluster 200 may deduce a response time and a damping time based on amounts of fuel when the fuel level of the fuel gauge is lowered from the full level to the empty level, a fuel consumption (FCO) deduced by the engine management system (EMS) 130, and a predetermined pre-damping time (S410 and S450).

In more detail, the cluster 200 may calculate the response time based on a difference between the amounts of fuel when the fuel level of the fuel gauge is lowered from the full level to the empty level. That is, the response time may be a value acquired by dividing the total amount of fuel, consumed while the fuel level of the fuel gauge is lowered from the full level to the empty level, by the fuel consumption (FCO) (S410).

The cluster 200 may determine whether or not the response time is longer than 0. The response time which is equal to or shorter than 0 may mean that the engine consumes no fuel but the vehicle is driving. For example, when the vehicle coasts, the response time may be 0. Therefore, in the present disclosure, in order to improve the actual fuel consumption following ability of the fuel gauge, determination as to the driving mode of the vehicle may be performed only when the response time is longer than 0 (S430).

The cluster 200 may set the damping time to a value acquired by multiplying the predetermined pre-damping time by a damping time tuning value. The damping time may be a value acquired by multiplying the predetermined pre-damping time by the damping time tuning value which is equal to or greater than 1. The reason why the damping time tuning value is equal to or greater than 1 is to improve the actual fuel consumption following ability of the fuel gauge in a driving mode in which reliability of a resistance variation value by the fuel sender 10 is lowered, such as when driving on a slope (S450).

The cluster 200 may compare the response time with the damping time. The cluster 200 may count the number of occurrences of the ON state of a track entry flag when the response time is shorter than the damping time, and count the number of occurrences of the OFF state of the track entry flag when the damping time is equal to or shorter than the response time. The cluster 200 may reset the previous count of the number of occurrences of the OFF state of the track entry flag when the number of occurrences of the ON state of the track entry flag is counted, and reset the previous count of the number of occurrences of the ON state of the track entry flag when the number of occurrences of the OFF state of the track entry flag is counted. That is, the cluster 200 may reset, when one of the number of occurrences of the ON state of the track entry flag and the number of occurrences of the OFF state of the track entry flag is counted, the previous count of the other of the number of occurrences of the ON state of the track entry flag and the number of occurrences of the OFF state of the track entry flag (S500, S610 and S630).

The cluster 200 may determine whether or not the counted number of occurrences of the ON state of the track entry flag reaches a predetermined number. When the counted number of occurrences of the ON state of the track entry flag reaches the predetermined number, the cluster 200 may determine whether the number of occurrences of the ON state of the track entry flag is consistently counted for a first delay time. That is, the cluster 200 may confirm whether or not one of the number of occurrences of the ON state of the track entry flag and the number of occurrences of the OFF state of the track entry flag is counted and the one of the number of occurrences of the ON state of the track entry flag and the number of occurrences of the OFF state of the track entry flag is consistently counted for a predetermined delay time (S710).

The cluster 200 may determine whether or not the counted number of occurrences of the OFF state of the track entry flag reaches a predetermined number. When the counted number of occurrences of the OFF state of the track entry flag reaches the predetermined number, the cluster 200 may determine whether the number of occurrences of the OFF state of the track entry flag is consistently counted for a second delay time. In order to reduce the frequency of switching from the track mode to the general mode as the driving mode of the vehicle, the second delay time may be longer than the first delay time (S730).

When the number of occurrences of the ON state of the track entry flag is counted for the first delay time, the cluster 200 may determine that the driving mode of the vehicle is the track mode (S810).

When the number of occurrences of the OFF state of the track entry flag, rather than the number of occurrences of the ON state of the track entry flag, is counted for the first delay time, the cluster 200 may maintain the current driving mode of the vehicle. That is, the cluster 200 may maintain the general mode which is the current driving mode of the vehicle (S830).

When the number of occurrences of the OFF state of the track entry flag is counted for the second delay time, the cluster 200 may determine that the driving mode of the vehicle is the general mode (S850).

When the number of occurrences of the ON state of the track entry flag, rather than the number of occurrences of the OFF state of the track entry flag, is counted for the second delay time, the cluster 200 may maintain the current driving mode of the vehicle. That is, the cluster 200 may maintain the track mode which is the current driving mode of the vehicle (S870).

Figure 5:
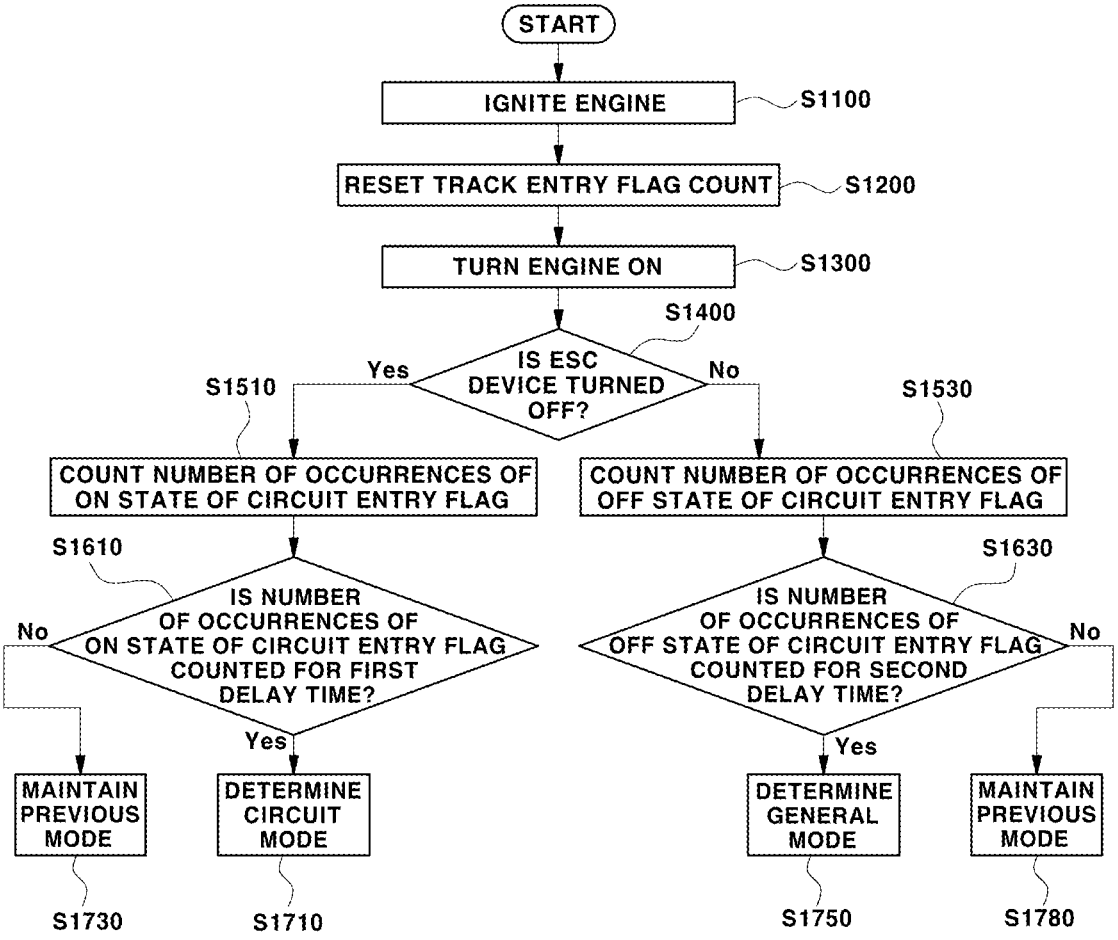
FIG. 5 is a flowchart illustrating a method for determining the driving mode of a vehicle according to another form of the present disclosure.

FIG. 5 is a flowchart illustrating a method for determining the driving mode of the vehicle according to another form of the present disclosure.

Referring to FIGS. 3 and 5, after ignition of the engine occurs (IG ON) (S1100), the cluster 200 may reset a track entry flag count (S1200).

When the engine is turned on (S300), the cluster 200 may receive information regarding ON or OFF of the ESC device 140. The ESC device 140 may be a device which monitors the posture of the vehicle in real time and adjusts engine output and braking of the vehicle when a dangerous situation occurs. Adjustment of the engine output is performed so as to inhibit wheel spinning when the vehicle is suddenly accelerated, and adjustment of braking of the vehicle is performed by controlling oversteer generated during turning through adjustment of the brake output of respective wheels, and thereby, the posture of the vehicle is controlled. The adjustment of the engine output and the adjustment of braking of the vehicle by ESC device 140 may be selectively turned on or off (S1300 and S1400).

The cluster 200 may count the number of occurrences of the ON state of the track entry flag when the ESC device 140 is turned off, and count the number of occurrences of the OFF state of the track entry flag when the ESC device 140 is turned on. The cluster 200 may reset the previous count of the number of occurrences of the OFF state of the track entry flag when the number of occurrences of the ON state of the track entry flag is counted, and reset the previous count of the number of occurrences of the ON state of the track entry flag when the number of occurrences of the OFF state of the track entry flag is counted. That is, the cluster 200 may reset, when one of the number of occurrences of the ON state of the track entry flag and the number of occurrences of the OFF state of the track entry flag is counted, the previous count of the other of the number of occurrences of the ON of the track entry flag and the number of occurrences of the OFF state of the track entry flag (S1510 and S1530).

The cluster 200 may determine whether or not the counted number of occurrences of the ON state of the track entry flag reaches a predetermined number. When the counted number of occurrences of the ON state of the track entry flag reaches the predetermined number, the cluster 200 may determine whether or not the number of occurrences of the ON state of the track entry flag is consistently counted for a first delay time. That is, the cluster 200 may confirm whether or not one of the number of occurrences of the ON state of the track entry flag and the number of occurrences of the OFF state of the track entry flag is counted and the one of the number of occurrences of the ON state of the track entry flag and the number of occurrences of the number of occurrences of the OFF state of the track entry flag is consistently counted for a predetermined delay time (S1610).

The cluster 200 may determine whether or not the counted number of occurrences of the OFF state of the track entry flag reaches a predetermined number. When the counted number of occurrences of the OFF state of the track entry flag reaches the predetermined number, the duster 200 may determine whether the number of occurrences of the OFF state of the track entry flag is consistently counted for a second delay time. In order to reduce the frequency of switching from the track mode to the general mode as the driving mode of the vehicle, the second delay time may be longer than the first delay time (S1630).

When the number of occurrences of the ON state of the track entry flag is counted for the first delay time, the cluster 200 may determine that the driving mode of the vehicle is the track mode (S1710).

When the number of occurrences of the OFF state of the track entry flag, rather than the number of occurrences of the ON state of the track entry flag, is counted for the first delay time, the cluster 200 may maintain the current driving mode of the vehicle. That is, the cluster 200 may maintain the general mode which is the current driving mode of the vehicle (S1730).

When the number of occurrences of the OFF state of the track entry flag is counted for the second delay time, the cluster 200 may determine that the driving mode of the vehicle is the general mode (S1750).

When the number of occurrences of the ON state of the track entry flag, rather than the number of occurrences of the OFF state of the track entry flag, is counted for the second delay time, the cluster 200 may maintain the current driving mode of the vehicle. That is, the cluster 200 may maintain the track mode which is the current driving mode of the vehicle (S1770).

Differently from FIGS. 4 and 5, various control logics for determining the driving mode of the vehicle may be used. In addition to the control logics described with reference to FIGS. 4 and 5, various control logics for determining the driving mode of the vehicle may be used.

Figure 6:
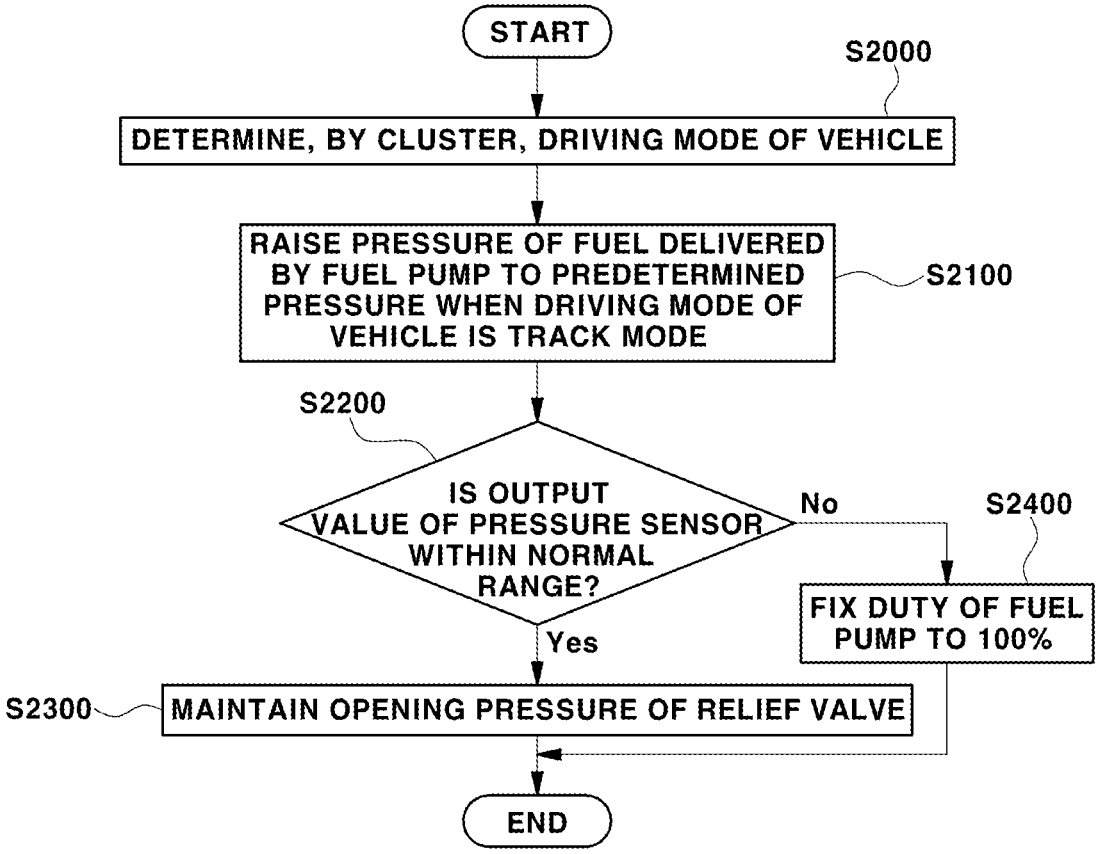
FIG. 6 is a flowchart illustrating a method for filling a fuel pump reservoir with fuel according to one form of the present disclosure.

FIG. 6 is a flowchart illustrating a method for filling a fuel pump reservoir with fuel according to one form of the present disclosure.

Referring to FIGS. 3 and 6, the cluster 200 may determine the driving mode of the vehicle. The cluster 200 may divide the driving mode of the vehicle into the general mode and the track mode (S2000).

When the driving mode of the vehicle is the track mode, the FPCM 300 may raise the pressure of the fuel delivered by the fuel pump 30 to a predetermined pressure. Here, the predetermined pressure may be calculated depending on the duty of the fuel pump 30 deduced based on a target pressure value received from the engine management system (EMS) 130. The predetermined pressure may be greater than the opening pressure of the relief valve 50 (S2100).

The pressure sensor 70 may consistently monitor the pressure of the fuel delivered to the engine. The FPCM 300 may monitor whether or not the output value of the pressure sensor 70 deviates from a normal range (S2200).

When the output value of the pressure sensor 70 is within the normal range, the FPCM 300 may maintain the current duty of the fuel pump 30. Further, the FPCM 300 may maintain the current opening pressure of the relief valve 50. That is, when the pressure sensor 70 does not fail and the output value of the pressure sensor is within the normal range, the current control methods of the fuel pump 30 and the relief valve 50 are not changed (S2300).

When the output value of the pressure sensor 70 deviates from the normal range, the FPCM 300 may confirm whether or not the pressure sensor 70 consistently outputs values deviating from the normal range for a designated time. When the pressure sensor 70 consistently outputs values deviating from the normal range for the designated time, the FPCM 300 may fix the duty of the fuel pump 30 to 100% so as to facilitate fuel supply to the engine.

As is apparent from the above description, in a fuel filling system according to the present disclosure, when the driving mode of the vehicle is a track mode, a second jet pump is operated and thus capability to fill a reservoir with fuel may be improved.

Further, in the fuel filling system according to the present disclosure, when a pressure sensor fails, the duty of the fuel pump is fixed to 100% and thus fuel supply to an engine in the track mode of the vehicle may be facilitated.

The disclosure has been described in detail with reference to exemplary forms thereof. However, it will be appreciated by those skilled in the art that changes may be made in these forms without departing from the principles and spirit of the present disclosure.

What is claimed is:

1. A fuel filling system of a fuel pump reservoir, the fuel filling system comprising:

a reservoir mounted inside a fuel tank configured to store fuel;

a fuel pump mounted inside the fuel pump reservoir, and configured to deliver the fuel in the fuel pump reservoir to an engine and to discharge a portion of the fuel to a fuel branch line, simultaneously;

a relief valve disposed on a fuel supply line, and configured to deliver the fuel from the fuel pump to the engine and to release pressure applied to a fuel supply line;

a first jet pump configured to fill the fuel pump reservoir with the fuel using fuel jet flow from the fuel branch line;

a second jet pump configured to fill the reservoir with the fuel using fuel jet flow from a fuel return line that is configured to receive the fuel returning from the relief valve; and a fuel pump control module (FPCM) configured to control operation of the second jet pump based on a driving mode of a vehicle.

2. The fuel filling system of claim 1, wherein:

the driving mode of the vehicle is one of a general mode or a track mode; and the driving mode of the vehicle is determined by a cluster.

3. The fuel filling system of claim 2, wherein upon determining that the driving mode of the vehicle is the track mode, the FPCM is configured to control the fuel pump to deliver the fuel at a predetermined pressure or at a pressure higher than the predetermined pressure.

4. The fuel filling system of claim 3, wherein when a pressure of the fuel delivered from the fuel pump is equal to or greater than the predetermined pressure, the fuel flows to the fuel return line by opening the relief valve; and an opening pressure of the relief valve is lower than the predetermined pressure.

5. The fuel filling system of claim 4, wherein the second jet pump is operated by the fuel flowing to the fuel return line.

6. The fuel filling system of claim 1, further comprising: a pressure sensor configured to measure a pressure of the fuel delivered to the engine, wherein, when the pressure of the fuel measured by the pressure sensor deviates from a normal range, the FPCM is configured to fix a duty of the fuel pump to 100%.

7. The fuel filling system of claim 6, wherein when the pressure of the fuel measured by the pressure sensor is within the normal range, the FPCM is configured to maintain the opening pressure of the relief valve.

8. The fuel filling system of claim 1, wherein:

when a pressure of the fuel delivered from the fuel pump is lower than an opening pressure of the relief valve, the first jet pump alone is operated; and when the pressure of the fuel delivered from the fuel pump is equal to or higher than the opening pressure of the relief valve, both the first jet pump and the second jet pump are operated.

9. The fuel filling system of claim 1, wherein:

the first jet pump comprises a first nozzle having a first injection hole through which the fuel passes; and the second jet pump comprises a second nozzle having a second injection hole through which the fuel passes, wherein a diameter of the second injection hole is greater than a diameter of the first injection hole.

10. The fuel filling system of claim 1, wherein:

the driving mode of the vehicle is determined by a cluster; and the cluster is configured to determine whether or not the driving mode of the vehicle is a general mode or a track mode based on whether or not an electronic stability control (ESC) device applied to the vehicle is turned off.

11. The fuel filling system of claim 1, wherein:

the driving mode of the vehicle is determined by a cluster; and the cluster determines whether or not the driving mode of the vehicle is a general mode or a track mode by comparing a damping time with a response time, wherein the damping time is a set value configured to limit a falling time of a fuel level in a fuel gauge, and the response time is an actual falling time of the fuel level in the fuel gauge from a full level to an empty level due to fuel consumption of the engine.

* * * * *